US006859939B1

(12) United States Patent
Osburn, Sr.

(10) Patent No.: US 6,859,939 B1
(45) Date of Patent: Mar. 1, 2005

(54) INFLATABLE RESTRAINT DEVICE

(76) Inventor: Ralph J Osburn, Sr., 6961 W. Riverside Way, San Jose, CA (US) 95129

( * ) Notice: Subject to any disclaimer, the term of this patent is extended or adjusted under 35 U.S.C. 154(b) by 184 days.

(21) Appl. No.: 10/277,118

(22) Filed: Oct. 21, 2002

(51) Int. Cl.[7] ..... A41D 13/00

(52) U.S. Cl. ..... 2/69; 2/455; 2/DIG. 3; 128/869; 128/875

(58) Field of Search ..... 2/455, 456, DIG. 3, 2/459–462, 465, 466–468, 267, 268, 16, 22, 44, 45, 2.14, 2, 15, 69, 79, 102, 92; 602/13; 128/845, 846, 847, 869, 875, 870, 873, 874, 876, 878, 882; 280/728.1, 729, 730.1, 733, 734, 735, 736; 441/92, 108, 55, 59, 60, 88, 96, 102, 103, 106, 119, 116, 110–112, 107, 118, 120–123

(56) References Cited

U.S. PATENT DOCUMENTS

| | | | | | |
|---|---|---|---|---|---|
| 276,121 | A | * | 4/1883 | Woodbury | 441/121 |
| 1,771,727 | A | | 7/1930 | Braun | |
| 2,607,934 | A | | 8/1952 | Bailhe | |
| 3,181,184 | A | * | 5/1965 | Potts | 441/108 |
| 3,224,415 | A | * | 12/1965 | Gottfried | 119/751 |
| 3,397,688 | A | * | 8/1968 | Gottfried | 602/13 |
| 3,895,396 | A | | 7/1975 | Amarantos | |
| 3,903,555 | A | * | 9/1975 | Busby | 441/116 |
| 3,972,526 | A | | 8/1976 | Cox, Jr. | |
| 4,047,255 | A | * | 9/1977 | Kiefer | 441/110 |
| 4,059,852 | A | | 11/1977 | Crane | |
| 4,453,271 | A | * | 6/1984 | Donzis | 2/456 |
| 4,496,328 | A | * | 1/1985 | Asher et al. | 441/55 |
| 4,685,151 | A | | 8/1987 | Kincheloe | |
| 5,101,815 | A | * | 4/1992 | Langdon-Orr et al. | 602/12 |
| 5,341,511 | A | * | 8/1994 | Wells | 2/456 |
| 5,362,098 | A | * | 11/1994 | Guill | 280/733 |
| 5,402,535 | A | * | 4/1995 | Green | 2/468 |
| 5,500,952 | A | | 3/1996 | Keyes | |
| 5,535,446 | A | * | 7/1996 | Pusic | 2/456 |
| 5,588,892 | A | * | 12/1996 | McMahon | 441/116 |
| 5,607,258 | A | * | 3/1997 | Eungard | 405/186 |
| 5,692,710 | A | | 12/1997 | Gee, Sr. | |
| 5,893,366 | A | * | 4/1999 | Odell et al. | 128/869 |
| 5,895,366 | A | * | 4/1999 | Bzoch | 602/24 |
| 5,937,443 | A | * | 8/1999 | Kageyama et al. | 2/69 |
| 6,012,162 | A | * | 1/2000 | Bullat | 2/2.5 |
| 6,122,772 | A | | 9/2000 | DeGuzman | |
| 6,125,478 | A | | 10/2000 | Alaloof | |
| 6,230,333 | B1 | * | 5/2001 | Umeda | 2/463 |
| 6,543,054 | B2 | * | 4/2003 | Gabriel | 2/1 |
| 6,546,561 | B2 | * | 4/2003 | Duhamell | 2/102 |
| 6,582,266 | B1 | * | 6/2003 | Steger et al. | 441/106 |
| 2002/0057946 | A1 | * | 5/2002 | Beltrani | 405/186 |

FOREIGN PATENT DOCUMENTS

| | | |
|---|---|---|
| FR | 2617794 | 1/1989 |

* cited by examiner

*Primary Examiner*—A. Vanatta
(74) *Attorney, Agent, or Firm*—Michael I. Kroll

(57) ABSTRACT

An inflatable restraint for selectively restraining the movement of a person. The inflatable restraint includes an inflation unit, a harness, and a plurality of selectively inflatable chambers connected to the harness. The chambers are strategically positioned around selective parts of a body of the person and held in position by the harness. When the inflation unit is activated the plurality of selectively inflatable chambers are caused to inflate thereby restricting movement of the selective body parts of the person.

14 Claims, 13 Drawing Sheets

INFLATABLE RESTRAINT DEVICE

BACKGROUND OF THE INVENTION

1. Field of the Invention

The present invention relates generally to restraining devices and, more specifically, to an inflatable restraining device controlled by a remote actuator for selectively restraining a person or object by selectively inflating the device around body parts directly associated with movement.

2. Description of the Prior Art

Numerous types of inflatable garments have been provided in the prior art. Typical of these are U.S. Pat. Nos. 1,771,727, 2,607,934; 3,895,396; 3,972,526; 4,059,852; 4,685,151, 5,535,446; 5,535,446; 5,692,710; 6,122,772; 6,125,478 and French Patent No FR2617794. While these devices may be suitable for the particular purpose to which they address, they would not be as suitable for the purposes of the present invention as hereto fore described.

In combination with the floor of an airplane, a collapsible gas chamber having one end secured therto, a seat secured to the opposite end of the chamber, a coil spring within said chamber having its opposite ends secured to said floor and said seat respectively, a locking member carried by said seat, and means supported by said floor adapted to cooperate with said locking member carried by said seat, and means supported by said floor adapted to cooperate with said locking member to hold said chamber and spring collapsed.

In a safety garment, an outer layer including a back panel and two front panels secured along their rear edges to the back panel, said front panels being provided with slide fastener closing means along their front edges, full length lining members for the front panels, corresponding in shape and size to the latter, secured along their rear, front and bottom edges to the edges of the front panels, a relatively narrow lining member extending along the upper portion of the back panel, a hollow collar formation composed of outer and under portions, the upper edge of the narrow lining member being secured to the interior edge of the outer collar portion so that an inverted back pocket is formed between that lining member and the back panel and which pocket communicates with the hollow collar, chest pockets formed by stitching together the material of the upper chest areas of the full length front lining members and of the front panels, said chest packets being closed circumferentially except at their top, the top openings of the chest pockets communicating with the hollow collar formation by way of said inverted back pocket; and a continuous inflatable element inserted into said chest pockets and the hollow collar formation; said collar formation being adapted to normally lay flat against the neck and shoulder areas of the garment but being further adapted to be turned upwards and to be held in it's upturned position when said element is inflated.

A lightweight multi-cell sheet like protective device that in a preferred embodiment is worn in a compact rolled donut shaped configuration about the waist of the user and is so maintained by spring means that form a part of the device. Upon an emergency arising, the supply means are manually actuated to inflate the cells, with the device then inflating from the first position to cover all of a desired portion of a users body to protect the user from a sudden shock or other changes of the environment that would be detrimental to him.

A recreational and amusement toy for children in the form of an inflated balloon-like jacket which covers the torso, permitting children to bounce or roll off one another while standing erect or while prone upon a lawn or soft-surface play area. The generally spherical configuration permits the child to quickly return to his feet from either a bounce or roll action when balance cannot be maintained. Arms can be retracted with bent elbow into the arm openings to permit the child to roll readily on the ground.

A protective garment for minimizing impact-caused injury, primarily to the body of a motorcyclist, comprising a body-part-enclosing covering means including an effectively hollow body-part-contoured inflatable bag provided with ingress port means and exterior inflating tube means communicating the ingress port means and pressurized gas supply means and the normally closed ingress valve means relative to fixed portions of a motorcycle for forcible opening actuation of the normally closed ingress valve means upon forced abrupt separation of a motorcyclist's body from a motorcycle as a result of an accident, for causing the rapid discharge of compressed gas through the open ingress valve means, inflating tube means, and ingress port means into the inflatable bag whereby to bring about abrupt inflation thereof in a body-protecting manner. In a preferred form, the inflating tube means is provided with controllably manually engageable and disengageable coupling means for allowing selective mounting and dismounting of a motorcyclist relative to a motorcycle without causing forced opening of the ingress valve means and the consequent abrupt inflation of the inflatable bag.

Motorcycle safety apparel is disclosed which may be made in stylish and unencumbering designs to encourage regular use by motorcycle riders, and the like, which in the event of an impending or actual accident will inflate to provide a protective enclosure for the parts of the body most susceptible to critical or fatal injury. In the motorcycle application, the apparel is coupled through an umbilical cord to a container of compressed or liquified gas, with a much shorter pull cord being coupled between the rider and the valve of the container to rapidly inflate the apparel on separation of the rider from the motorcycle prior to separation of the umbilical cord.

The invention is a self-contained protective device/system designed to protect the hips, pelvis, buttocks, and coccyx areas of the user. The device may be worn outside of the clothing. Because it is small in size and lightweight, it may be easily put on and removed and does not interfere with body movements. It contains the following components: an inflatable air bag folded into pleats, a battery, a gas cartridge, sensors to determine angular motion and acceleration, a triggering/valve mechanism to release the gas and a relief valve. When the user falls, the sensors automatically release gas from the cartridge and inflate the airbag assembly, forcing the folded pleats to fully cover said areas of the user's body. After use the relief valve is opened to release air from the airbag assembly, the pleats are reinserted into the system and the invention is ready for reuse after the spent cartridge is replaced. The invention is superior to prior art because of its automatic deployment, compact size, lightweight, ease of use and reusability. In this embodiment it will afford much needed protection to the elderly and infirm.

Inflatable airstrips for protection of a motorcyclist body in case of a traffic accident are disclosed. The airstrips comprise plurality of horizontal and vertical air strips which are all interconnected and inflated with gas from two gas inflators. A gas diffusing process is initiated by an activating cord which is extended from the ignitor unit and attached to the motorcycle.

An inflatable restraint is disclosed, and includes an elongated poncho having therein an airtight bladder and a cervical aperture for insertion of the head of the individual. A front portion of the poncho is adapted for juxtaposition with a rear surface of a forward seat and a rear portion is adapted for juxtaposition with and between the back of the torso and a forward surface of a rearward seat when inflated. The front portion is longer than the rear portion and has a larger volumetric displacement when inflated and extends over the front torso and lower extremities of the individual. The rear portion extends over the back torso of the individual. An inflation means inflates the bladder and restrains the individual between the forward and rearward seats for protection of the individual during an emergency while traveling in a vehicle.

An apparatus and method are disclosed for reducing or minimizing the particulates and other contaminants which may be brought into a restricted or clean room area. The apparatus and methods include a gown having positioning elements for keeping portions of the gown in place to permit inflation of the gown, for example during an airwash, and the apparatus and methods may also include gown inflation apparatus to remove the particulates and contaminants. Apparatus and methods of the present inventions also inflate the gown not only to eject particulates and contaminants that may be entrained or caught in the gown fabric, but also can be used to inflate the gown while the operator is in an air shower. Methods and apparatus of the present inventions also provide for an improved glove to gown seal, in addition to a reduced possibility of contamination from particulates or moisture from the operator's hands and an enhanced comfort level in the use of latex or rubber gloves with the gown. These and other features and benefits of the inventions disclosed herein will be more fully understood upon consideration of the following descriptions.

A protective system including a garment-shaped inflatable member for surrounding at least upper portions of the body of a rider of a non-enclosed vehicle, and apparatus for exposing the interior of the inflatable member to the pressurized gas source for rapidly inflating the inflatable member in response to a sudden eparation of the rider from the vehicle by at least a predetermined distance. The inflatable member has a garment-shaped configuration when in a non-inflated orientation, and when inflated, has an expanded, generally bulbous configuration such that large magnitude concentrated forces experienced thereby on impact with n object subsequent to the sudden separation of the rider from wherein the vehicle are prevented from transfer directly to the rider, thereby protecting the surrounded upper portions of the rider's body from serious injury.

The present invention relates to a safety device for users falling in the water. This device is characterized in that it is composed of a garment, particularly a waistcoat, a jacket, a coat or a windcheater intended to be worn by the user, this garment including at least one inflatable pocket connected by means of a supply hose to a cartridge of compressed gas provided with blocking members interact with triggering members sensitive to contact with the water and in return driving the blocking members for opening the cartridge of compressed gas and supplying the supply hose in order to inflate the pocket or pockets and allow it to act as a buoy. While these inflatable garments may be suitable for the purposes for which they were designed, they would not be as suitable for the purposes of the present invention, as hereinafter described.

SUMMARY OF THE PRESENT INVENTION

The present invention relates generally to restraining devices and, more specifically, to an inflatable restraining device controlled by a remote actuator for selectively restraining a person or object by selectively inflating the device around body parts directly associated with movement.

A primary object of the present invention is to provide an inflatable restraint device that will over come the shortcomings of the prior art. A further object of the present invention is to provide an inflatable restraint device for selectively restraining a person or object to which the device.

Another object of the present invention is to provide an inflatable restraint device that can be selectively actuated by a remote actuator.

Still another object of the present invention is to provide an inflatable restraint device that allows the user to selectively determine the amount of air used when inflating the inflatable restraint.

Another object of the present claimed invention is to provide an inflatable restraint device having a plurality of chambers that are selectively inflatable, the chambers are fit around the arms, legs and head of the person wearing the inflatable restraint device.

Yet another object of the present invention is to provide an inflatable restraint device for restricting the movement of the arms, legs and head of the person outfitted with the inflatable restraint when the chambers of the device are pressurized.

Still another object of the present invention is to provide an inflatable restraint device to be used in conjunction with law enforcement, more specifically with transportation of inmates to and from various places.

Yet another object of the present invention is to provide an inflatable restraint device for inmates that would allow law enforcement officials to subdue a person wearing the inflatable restraint from a distance using non-lethal force.

One other object of the present invention is to provide an inflatable restraint device that is lightweight and nonrestrictive when not inflated.

Another object of the present invention is to provide an inflatable restraint device for inmates that is simple and easy to use.

Yet another object of the present invention is to provide an inflatable restraint device for inmates that is inexpensive to manufacture to and operate.

Additional objects of the present invention will appear as the description proceeds.

The foregoing and other objects and advantages will appear from the description to follow. In the description reference is made to the accompanying drawing, which forms a part hereof, and is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

BRIEF DESCRIPTION OF THE DRAWING FIGURES

In order that the invention may be more fully understood, it will now be described, by way of example, with reference to the accompanying drawing in which.

Figure 12:
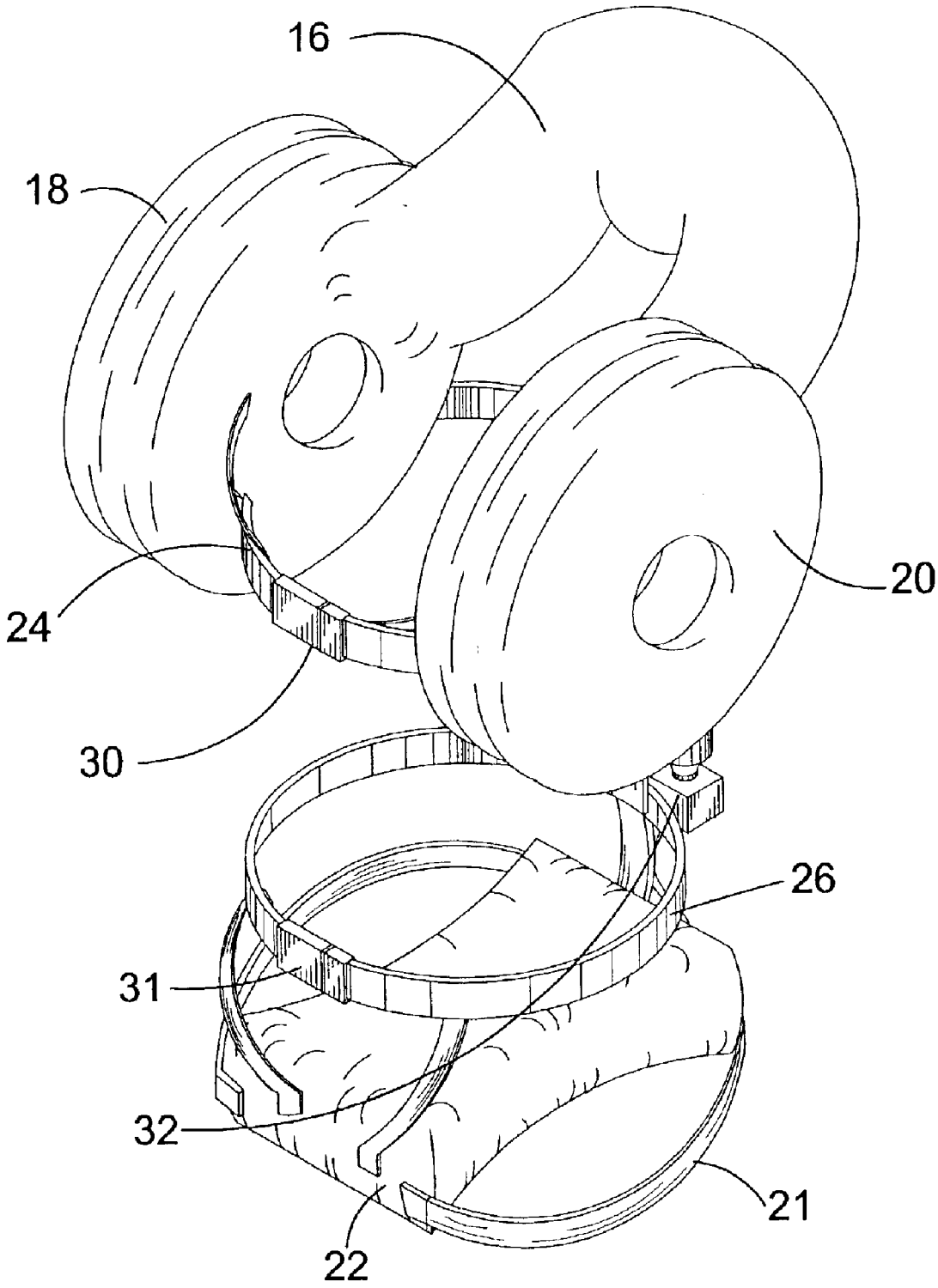
Figure 13:
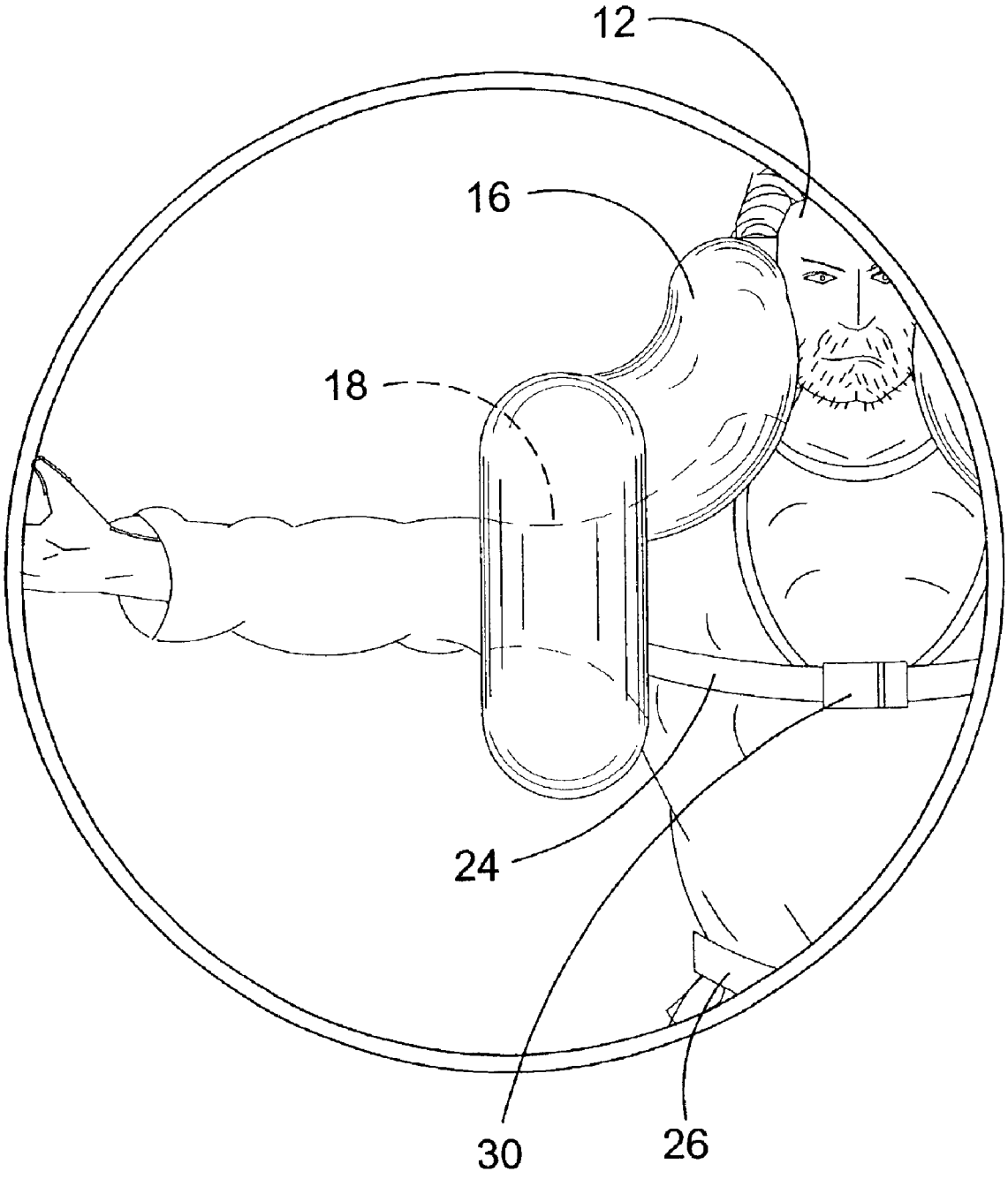

FIG. 12 a perspective view of the inflatable restraint of the present invention in an inflated state; and FIG. 13 a detailed illustrative view of a right side of the inflatable restraint of the present invention in its inflated state.

DESCRIPTION OF THE REFERENCED NUMERALS

Turning now descriptively to the drawings, in which similar reference characters denote similar elements throughout the several views, the Figures illustrate the inflatable restraint. With regard to the reference numerals used, the following numbering is used throughout the various drawing Figures.

| | |
|---|---|
| 10 | inflatable restraint of the present invention |
| 12 | detainee |
| 14 | person |
| 16 | neck chamber |
| 18 | right arm chamber |
| 20 | left arm chamber |
| 22 | leg chamber |
| 21 | thigh strap |
| 24 | upper harness |
| 26 | lower harness |
| 30 | locking mechanism |
| 32 | inflation unit |
| 34 | upper support member |
| 36 | lower support member |
| 38 | upper inflation line |
| 40 | lower inflation line |
| 42 | compressed air tanks |
| 44 | receiver |
| 46 | upper valve release |
| 48 | lower valve release |
| 50 | valve control unit |
| 52 | air |
| 54 | remote |
| 56 | activation button |
| 58 | decrease pressurize button |
| 60 | increase pressure button |
| 62 | transmitter |
| 64 | remote power source |

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Turning now descriptively to the drawings in which similar reference characters denote similar elements through out the several views, FIGS. 1–13 illustrate the inflatable restrain of the present invention indicated generally by the numeral 10.

Figure 1:
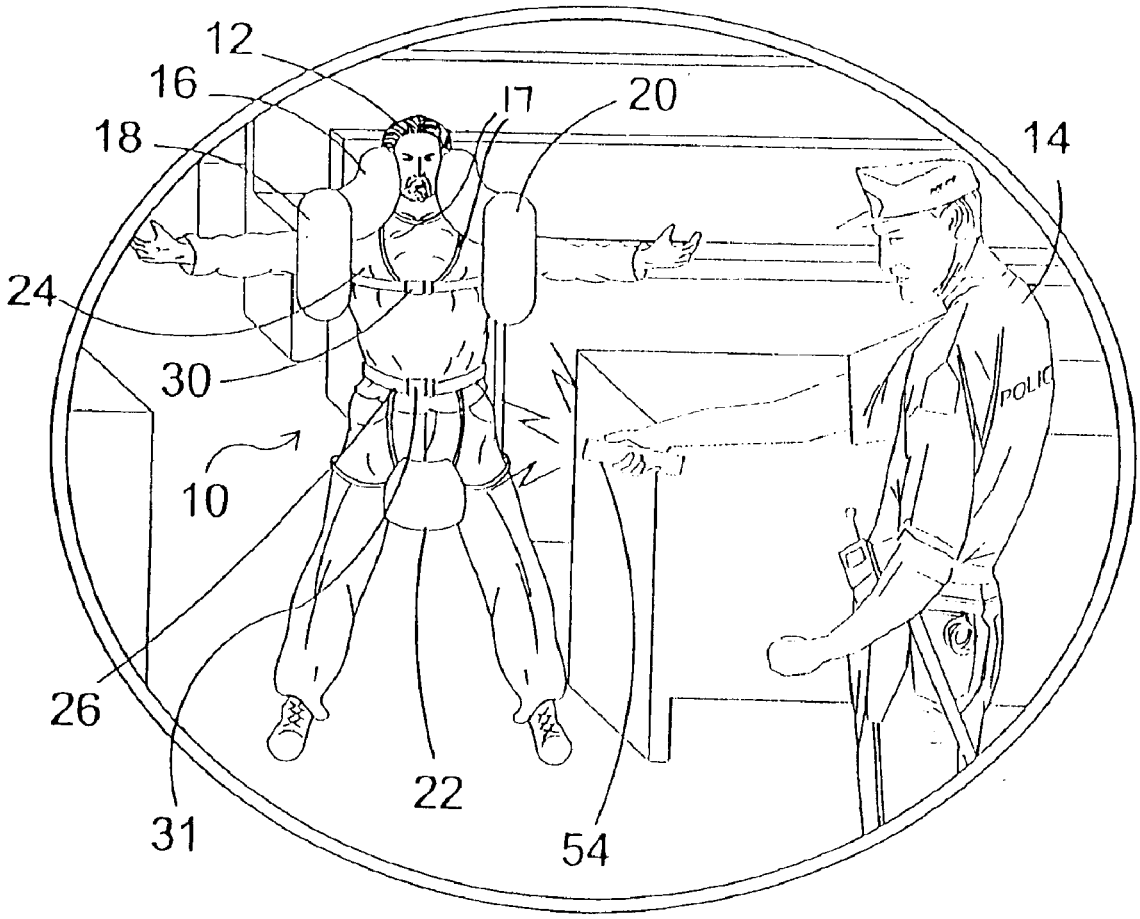
FIG. 1 is a perspective view of the inflatable restraint of the present invention in use immobilizing a detainee.

FIG. 1 is an illustrative view of the inflatable restraint 10 of the present invention immobilizing a detainee. The inflatable restraint 10 is designed to instantly inflate and thereby immobilize a detainee 12. Preferably, the detainee is a prisoner, however, any person who may require instantaneous immobilization can be outfitted with the inflatable restraint 10 of the present invention. Using the inflatable restraint 10 allows for non-lethal immobilization. The inflatable restraint 10 has a plurality of inflatable members that, when inflated, are designed to restrict and inhibit the movement of the person wearing the restraint 10.

Figure 2:
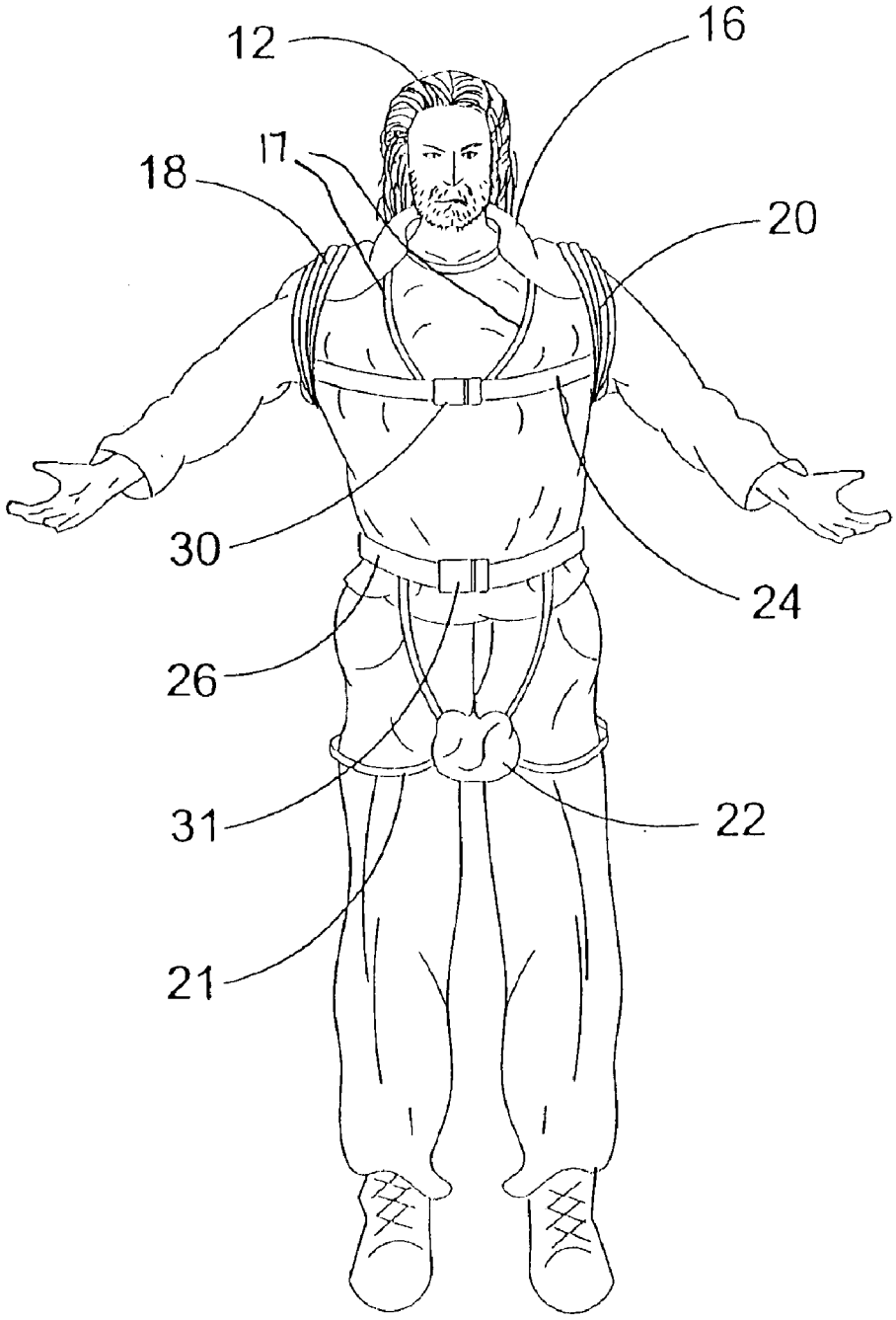
FIG. 2 is front view of the inflatable restraint of a person wearing the present invention in a non-inflated state.

FIG. 1 shows a person 14 using the inflatable restraint 10 of the present invention to effectively immobilize a detainee 12. The detainee 12 is wearing the inflatable restraint 10. The inflatable restraint 10 is attached to a detainee by an upper harness 24 secured around a chest or upper torso of the detainee and a lower harness 26 secured around a waist of the detainee. The upper harness 24 and lower harness 26 are connected to an inflation unit 32 by an upper support member 34 and a lower support member 36 as can be seen in FIG. 2. The upper harness 24 is positioned around the upper torso of the detainee 12 using shoulder straps 17 and secured by a locking mechanism 31. The upper harness 24 has a neck chamber 16 to be positioned on either side of the neck of a detainee 12 and extends partially around the neck. The neck chamber 16 includes a left side inflatable pad and a right side inflatable pad positioned on the left and right sides of the detainee's neck, respectively. The upper harness 24 also has a right arm chamber 18 and a left arm chamber 20. The right arm chamber 18 is able to receive the right arm of the detainee 12. The left arm chamber 20 is able to receive the left arm of the detainee 12. The lower harness 26 of the inflatable restraint 10 is positioned around the waist and legs of the detainee 12. The lower harness 26 is secured to the detainee by thigh straps 21 and is secured in place by a locking mechanism 30. The lower harness 26 has an inflatable leg chamber is positioned between the legs of the detainee 12.

When immobilization is required, a person 14, preferably a law enforcement official, activates a remote control 54 which remotely sends a signal to the inflation unit 32 (not shown) which releases air into the neck chamber 16, the right arm chamber 18, the left arm chamber 20, and the leg chamber 22. Upon receipt of an inflate command the neck chamber 16, right arm chamber 18, left arm chamber 20 and leg chamber 22 will inflate as shown in FIG. 1, whereby a detainee 12 is unable to move due to the inflated chambers surrounding his appendages. The inflatable chambers are preferably positioned around the joints of the wearer 12 and thereby restrict movement sufficiently enough to prevent any resistance attempted by the detainee 12 and also adequately prevents attempted escape by the detainee.

Figure 3:
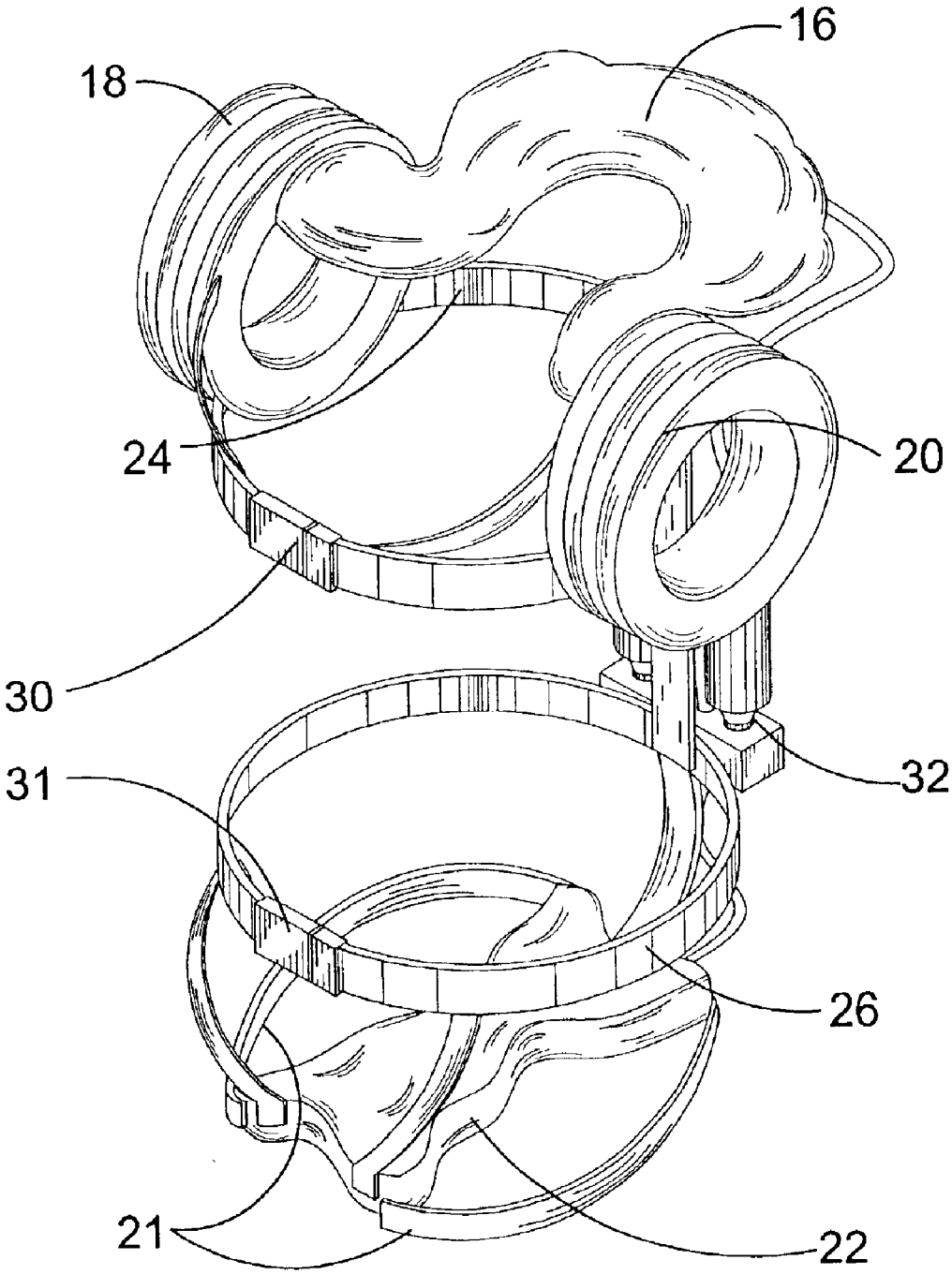
FIG. 3 is a perspective view of the inflatable restraint of the present invention.
Figure 4:
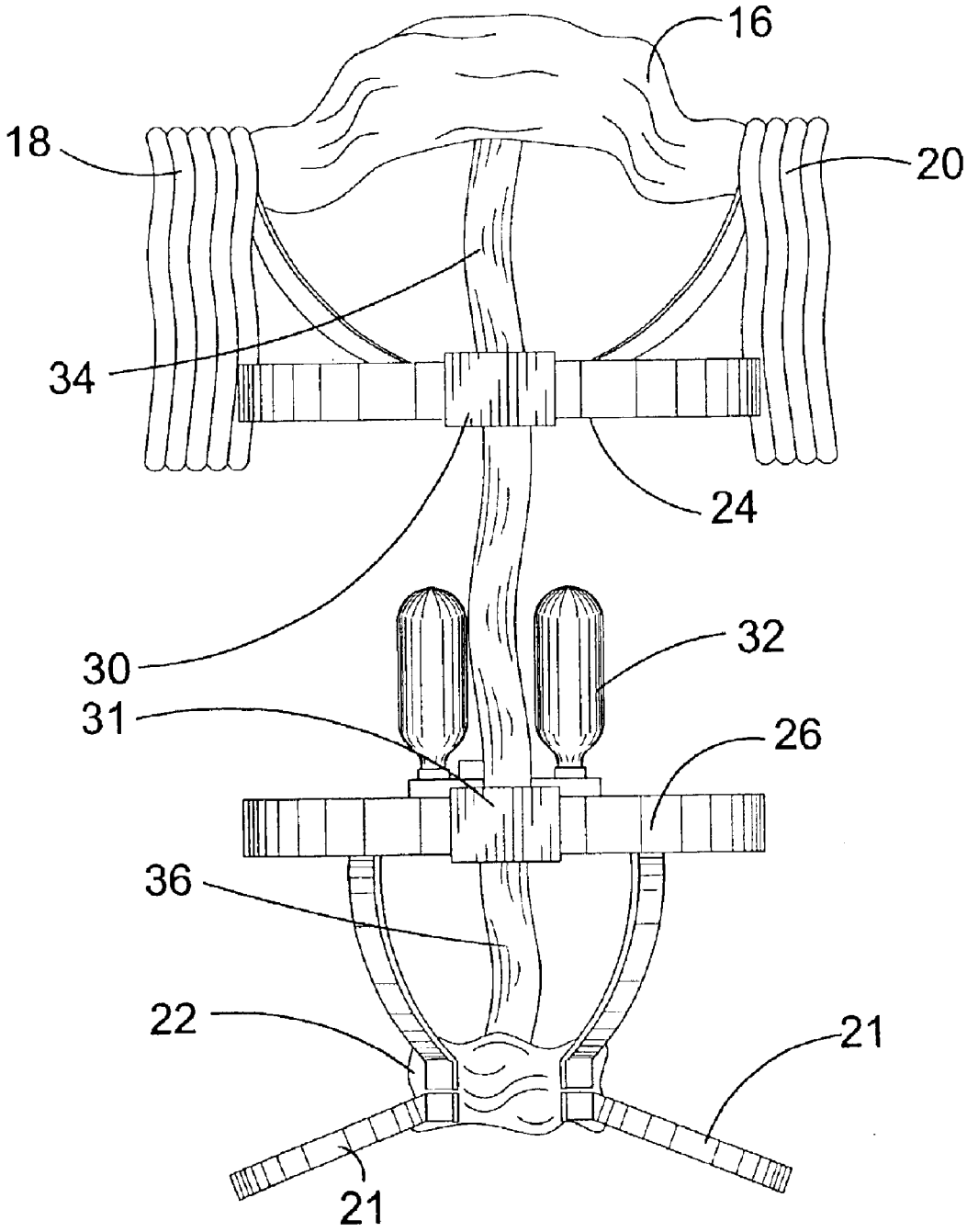
FIG. 4 is a front view of the inflatable restraint of the present invention.
Figure 5:
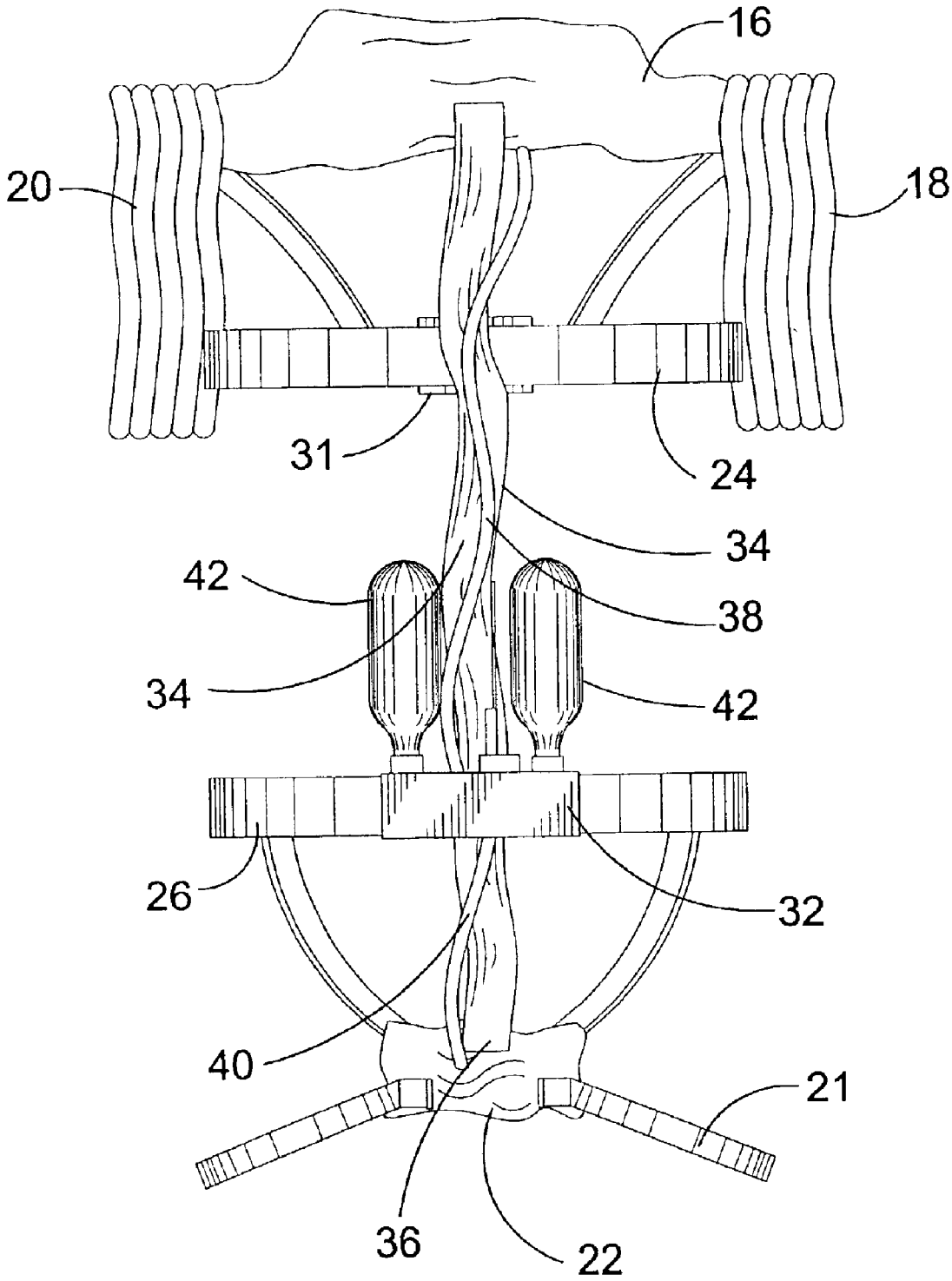
FIG. 5 is a rear view of the inflatable restraint of the present invention.

FIG. 2 is an illustrative view of the inflatable restraint of the present invention in a non-inflated state on a detainee. The detainee 12 is wearing the inflatable restraint 10. The inflatable restraint 10 is attached to a detainee by an upper harness 24 and a lower harness 26. The upper harness 24 and lower harness 26 are both connected to an inflation unit 32 by an upper support member 34 and a lower support member 36 as can be seen in FIGS. 3–5. The upper harness 24 is preferably maintained around the upper torso of the detainee 12 by shoulder straps 17 and is secured in position by a locking mechanism 30. The upper harness 24 is connected to a neck chamber 16 extending around a rear side of the neck of a detainee 12. The upper harness 24 is also connected to both a right arm chamber 18 and a left arm chamber 20. The right arm chamber 18 preferably receives the right arm of the detainee 12 and is positioned at the joint between the right arm and shoulder. The left arm chamber 20 preferably receives the left arm of the detainee 12 and is positioned at the joint between the left arm and shoulder. The lower harness 26 of the inflatable restraint 10 is preferably maintained around the waist and legs of the detainee 12 by thigh straps 21 and is secured in position by a locking mechanism 31. The lower harness a leg chamber positioned between the legs of the detainee 12 and held in position by the thigh straps 21. As shown here in the non-inflated state, the detainee 12 still has full movement capabilities to move. This is especially useful when transporting a detainee 12 from one place to another.

FIG. 3 is a perspective view of the inflatable restraint of the present invention. The inflatable restraint 10 is shown deflated. The inflatable restraint 10 includes an upper harness 24 and a lower harness 26. The upper harness 24 and lower harness 26 are both connected to an inflation unit 32 by an upper support member 34 and a lower support member 36 as can be seen in FIGS. 3–5. The upper harness 24 is preferably maintained around the upper torso of the detainee 12 by shoulder straps 17 and is secured in position by a locking mechanism 30. The upper harness 24 is connected to a neck chamber 16 extending around a rear side of the neck of a detainee 12. The upper harness 24 is also connected to both a right arm chamber 18 and a left arm chamber 20. The right arm chamber 18 preferably receives the right arm of the detainee 12 and is positioned at the joint between the right arm and shoulder. The left arm chamber 20 preferably receives the left arm of the detainee 12 and is positioned at the joint between the left arm and shoulder. The lower harness 26 of the inflatable restraint 10 is preferably maintained around the waist and legs of the detainee 12 by thigh straps 21 and is secured in position by a locking mechanism 31. The lower harness a leg chamber positioned between the legs of the detainee 12 and held in position by the thigh straps 21.

FIG. 4 is a front view of the inflatable restraint of the present invention. The inflatable restraint 10 is shown in a deflated state. The inflatable restraint 10 is shown having an inflation unit 32 and an upper and lower harness 24,26. The upper harness 24 and lower harness 26 are both connected to an inflation unit 32 by an upper support member 34 and a lower support member 36 as can be seen in FIGS. 3–5. The upper harness 24 is preferably maintained around the upper torso of the detainee 12 by shoulder straps 17 and is secured in position by a locking mechanism 30. The upper harness 24 is connected to a neck chamber 16 extending around a rear side of the neck of a detainee 12. The upper harness 24 is also connected to both a right arm chamber 18 and a left arm chamber 20. The right arm chamber 18 preferably receives the right arm of the detainee 12 and is positioned at the joint between the right arm and shoulder. The left arm chamber 20 preferably receives the left arm of the detainee 12 and is positioned at the joint between the left arm and shoulder. The lower harness 26 of the inflatable restraint 10 is preferably maintained around the waist and legs of the detainee 12 by thigh straps 21 and is secured in position by a locking mechanism 31. The lower harness a leg chamber positioned between the legs of the detainee 12 and held in position by the thigh straps 21.

FIG. 5 is a rear view of the inflatable restraint of the present invention. The inflatable restraint 10 is shown in a deflated state. The inflatable restraint 10 is shown having an inflation unit 32 and an upper and lower harness 24,26. The upper harness 24 and lower harness 26 are both connected to an inflation unit 32 by an upper support member 34 and a lower support member 36 as can be seen in FIGS. 3–5. The upper harness 24 is preferably maintained around the upper torso of the detainee 12 by shoulder straps 17 and is secured in position by a locking mechanism 30. The upper harness 24 is connected to a neck chamber 16 extending around a rear side of the neck of a detainee 12. The upper harness 24 is also connected to both a right arm chamber 18 and a left arm chamber 20. The right arm chamber 18 preferably receives the right arm of the detainee 12 and is positioned at the joint between the right arm and shoulder. The left arm chamber 20 preferably receives the left arm of the detainee 12 and is positioned at the joint between the left arm and shoulder. Contained within the perimeter of the upper connection member 34 is an upper inflation line 38. The upper inflation line 38 selectively supplies compressed air from an air tank 42 of the inflation unit 32 to the neck chamber 16, the right arm chamber 18 and the left arm chamber 20, and possibly the leg chamber 22. The upper inflation line 38 is enclosed with a hard but flexible material, such as plastic, to prevent cutting or breaking thereof. While plastic is preferable, any material that would prevent cutting or breaking of the upper inflation line 38 while remaining bendable may be used. The lower harness 26 of the inflatable restraint 10 is preferably maintained around the waist and legs of the detainee 12 by thigh straps 21 and is secured in position by a locking mechanism 31. The lower harness a leg chamber positioned between the legs of the detainee 12 and held in position by the thigh straps 21. Contained within the perimeter of the lower connection member 36 is a lower inflation line 40. The lower inflation line 40 selectively supplies compressed air from the tank 42 to inflate the leg chamber 22. The lower inflation line 40 may also alternatively provide air to inflate the neck chamber 16, right arm chamber 18, and left arm chamber 20. The lower inflation line 40 is enclosed with a hard but flexible material, such as plastic, to prevent cutting or breaking thereof. While plastic is preferable, any material that would prevent cutting or breaking of the lower inflation line 40 while remaining flexible may be used.

Figure 6:
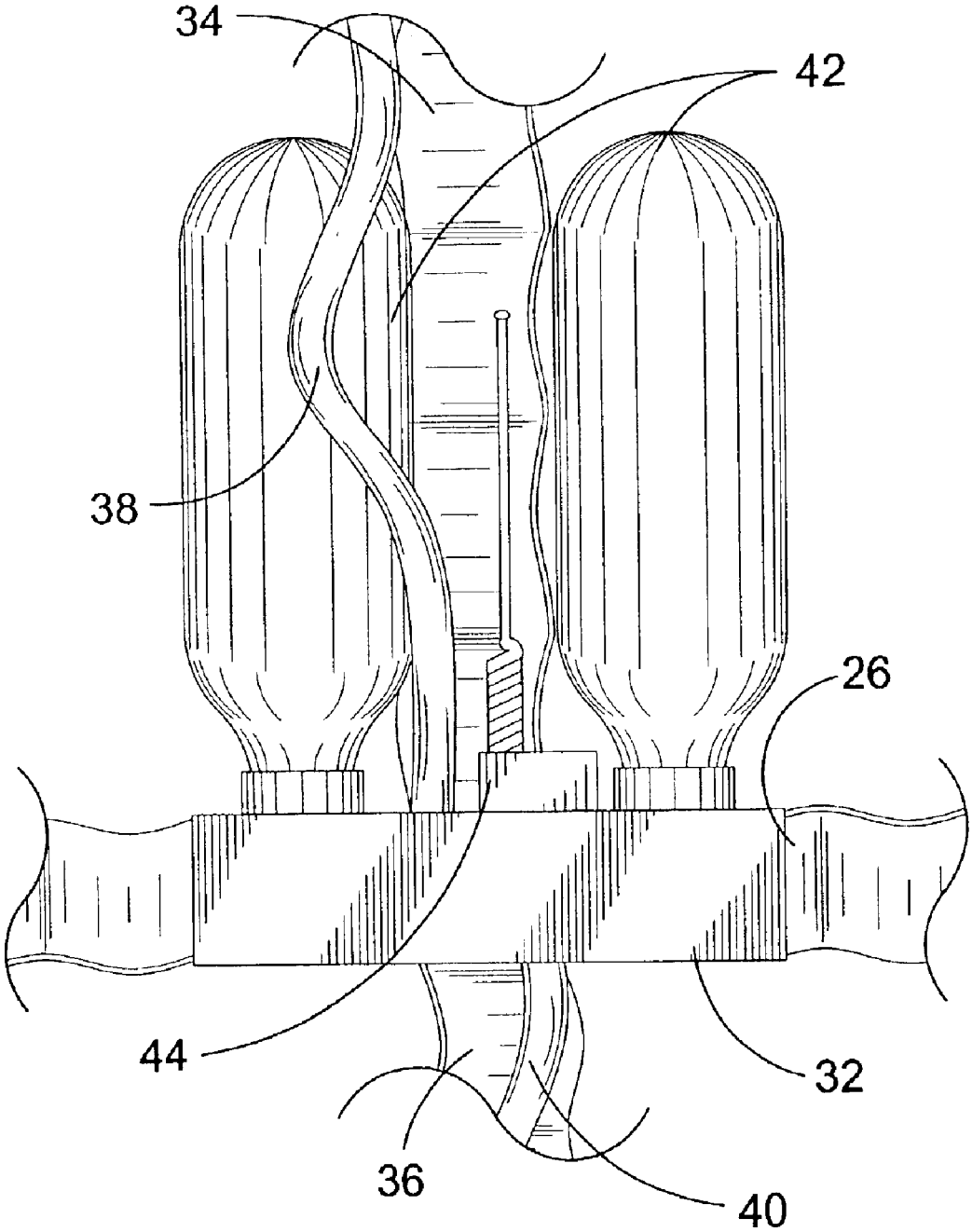
FIG. 6 is a detailed front view of the inflation unit of the inflatable restraint of the present invention.

FIG. 6 is a detailed front view of the inflation unit 32 of the inflatable restraint of the present invention. The inflation unit 32 includes a housing 31 and two compressed air tanks 42. Positioned on the housing is a receiver 44 for receiving a signal from a remote control unit 54. This signal controls the release of air from the compressed air tanks 42 for inflating the chambers 16, 18, 20, and 22. Connected to the air tanks 42 and extending from the housing 31 of the inflation unit 32 are an upper inflation line 38 and a lower inflation line 40. The upper inflation line is contained within the upper connection member 34 and preferable connected to inflate the neck chamber 16, right arm chamber 18, left arm chamber 20. The upper inflation line 38 may also be connected to inflate the leg chamber 22. The lower inflation line 40 is contained within the lower connection member 36. The lower inflation line 40 is connected to inflate the leg chamber 22. The lower inflation line 40 may also be connected to inflate the neck chamber 16, the right arm chamber 18, and the left arm chamber 20.

Figure 7:
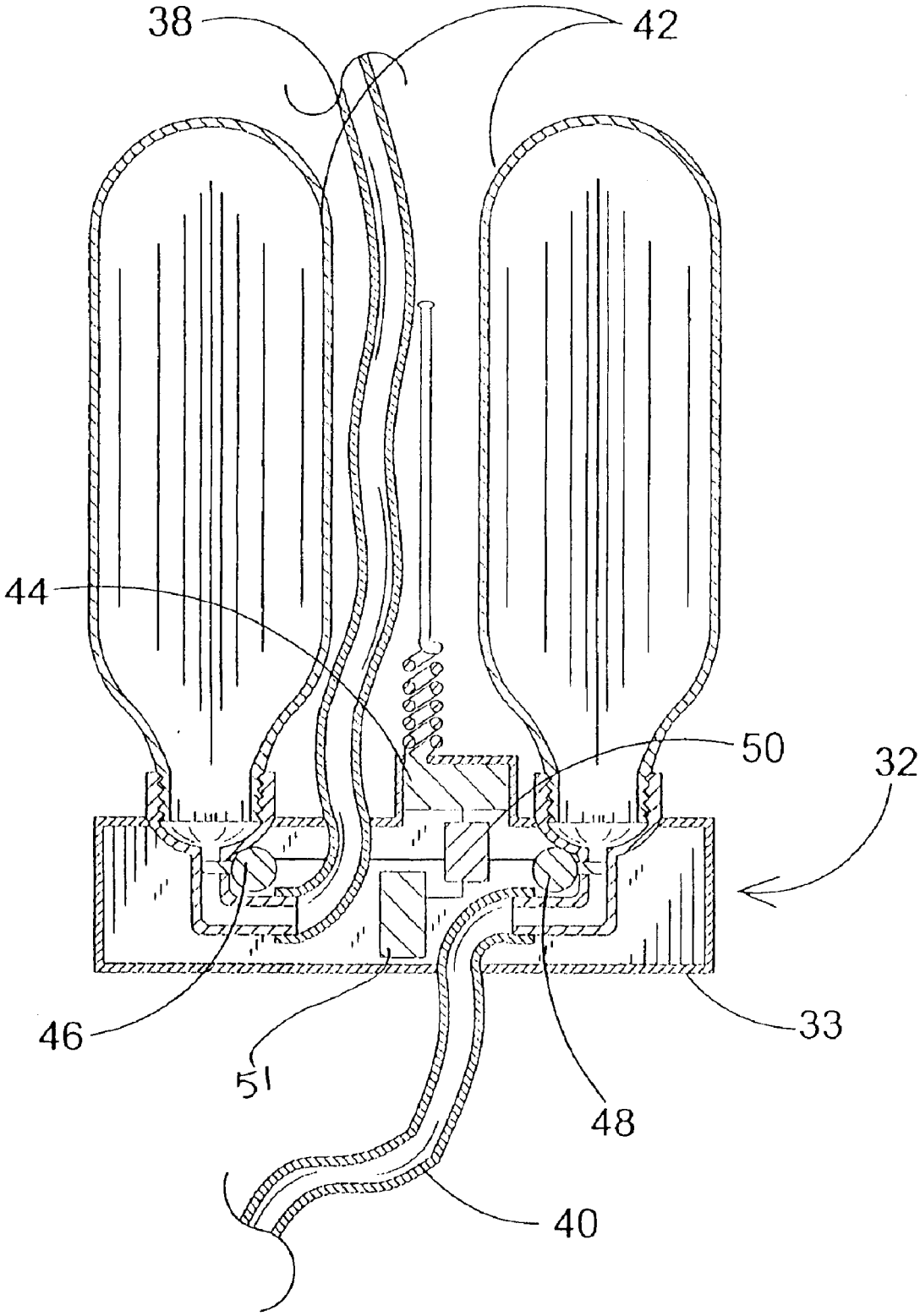
FIG. 7 is a cross-sectional view of the inflation unit of the inflatable restraint of the present invention.

FIG. 7 is a cross-sectional view of the inflation unit of the inflatable restraint of the present invention. The inflation unit 32 includes a housing 33 and two compressed air tanks 42. The housing 33 of the inflation unit 32 includes a power source 51 and a valve control unit 50. The valve control unit 50 receives operating power from the power source 51. Also included within the housing 33 is a upper release valve 46 and a lower release valve 48. Positioned on the housing 33 is a receiver 44 for receiving a signal from a remote control unit 54. Extending from the housing 33 of the inflation unit 32 are an upper inflation line 38 and a lower inflation line 40. The upper inflation line is contained within the upper connection member 34 and preferable connected to inflate the neck chamber 16, right arm chamber 18, left arm chamber 20. The upper inflation line 38 may also be connected to inflate the leg chamber 22. The lower inflation line 40 is contained within the lower connection member 36. The lower inflation line 40 is connected to inflate the leg chamber 22. The lower inflation line 40 may also be connected to inflate the neck chamber 16, the right arm chamber 18, and the left arm chamber 20. When the receiver 44 receives an inflation signal from a remote control 54, the receiver 44 controls the valve control unit 50 which is powered by a power source 51. Once activated, the valve control unit 50 controls the upper release valve 46 and the lower release valve 48 to open, thereby providing the compressed air in the tanks 42 to the upper and lower inflation lines 38 and 40, respectively. The compressed air travels through the upper inflation line 38 and lower inflation line 40 to inflate the inflatable chambers of the inflatable restraint 10.

Figure 8:
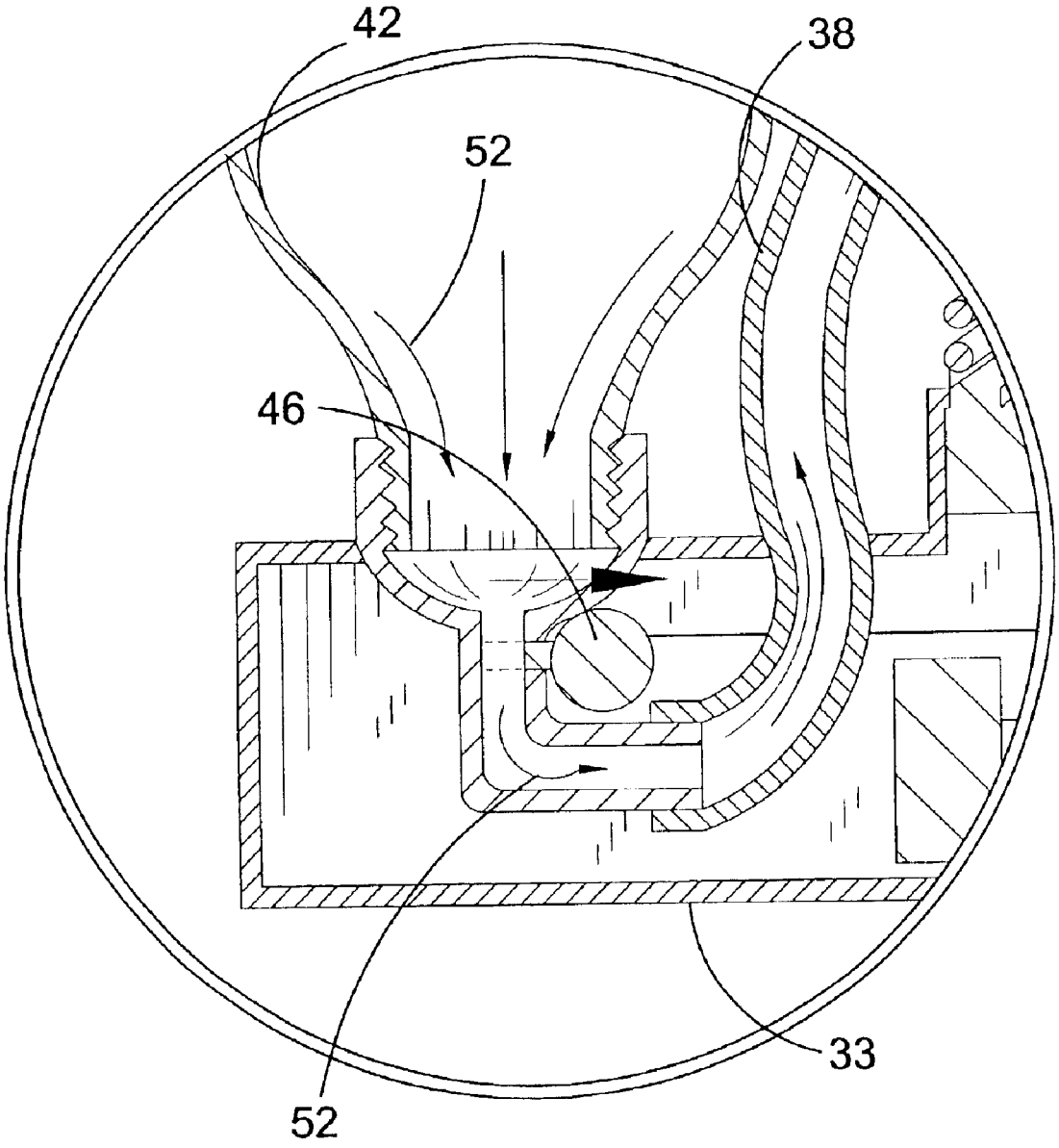
FIG. 8 is a detailed cross sectional view of the valve system of the inflation unit of the inflatable restraint of the present invention.

FIG. 8 is a detailed sectional view of the valve system of the inflation unit of the inflatable restraint of the present invention. The inflation unit 32 includes a housing 31 and two compressed air tanks 42. The housing 31 of the inflation unit 32 includes a power source 51 and a valve control unit 50. The valve control unit 50 receives operating power from the power source 51. Shown herein is the upper release valve 46 for controlling the release of compressed air indicated by arrows labeled 52. The tank 42 is connected to an upper inflation line 38. When the receiver 44 receives an inflation signal from a remote control 54, the receiver 44 controls the valve control unit 50 which is powered by a power source 51. Once activated, the valve control unit 50 controls the upper release valve 46 and the lower release valve 48 to open, thereby providing the compressed air in the tanks 42 to the upper and lower inflation lines 38 and 40, respectively. The compressed air travels through the upper inflation line 38 and lower inflation line 40 to inflate the inflatable chambers of the inflatable restraint 10.

Figure 9:
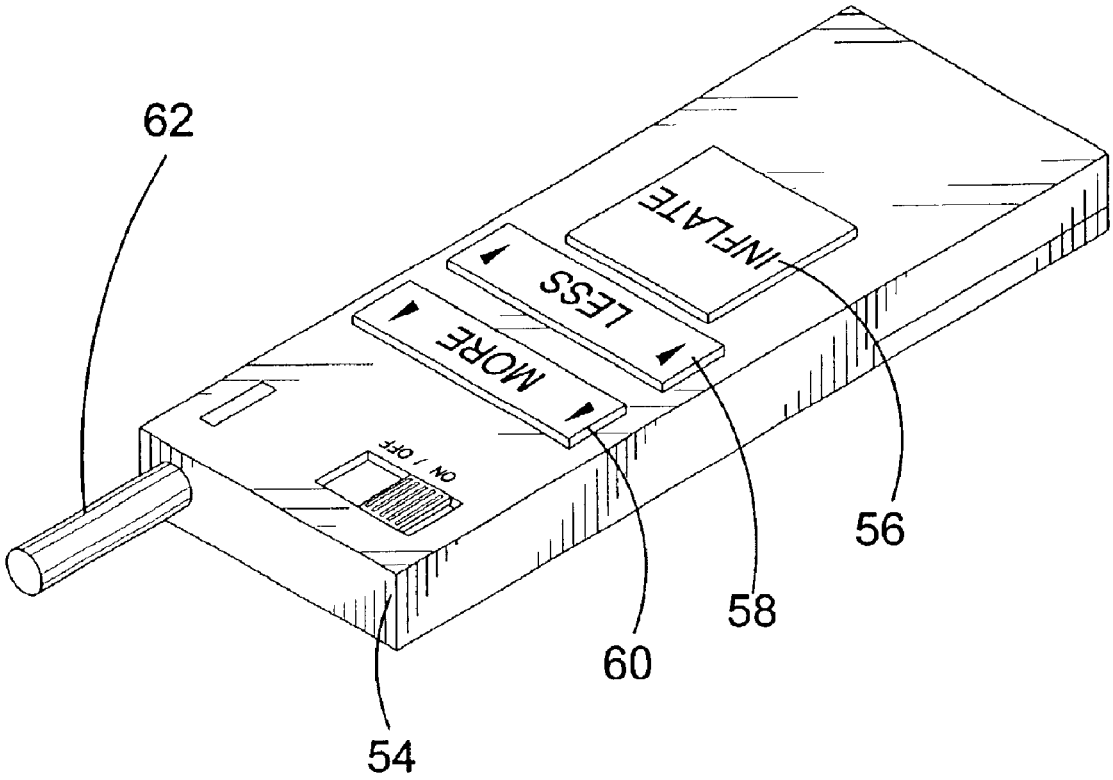
FIG. 9 is a perspective view of the remote control unit of the inflatable restraint of the present invention.

FIG. 9 is a perspective view of the remote control unit 54 of the inflatable restraint of the present invention. The remote control unit 54 has a transmitter and antenna 62 for sending signals to the receiver 44 of the inflation unit 32. The remote control has an activation button 56 for instant activation of the inflation unit 32. Instant activation of the inflation unit 32 causes compressed air to be delivered to the neck chamber 16, right arm chamber 18, left arm chamber 20, and leg chamber 22 thereby filling these chambers and causing immediate immobilization of any person outfitted with the inflatable restraint 10. The level of air which is released into the inflatable members of the inflatable restraint 10 upon activation of the activation button 56 is predetermined and is based upon the body size of the individual wearing the restraint 10. The remote control unit 54 also includes a decrease pressure button 58 and an increase pressure button 60. The increase pressure button 60 signals the valve control unit 50 to open the upper release 46 and lower release valve 48. Activation of the increase pressure button 60 allows the person activating the inflatable restraint 10 the ability to apply more pressure and further subdue a person wearing the restraint 10. The decrease pressure button 58 functions to reduce the pressure in the inflatable members when the person 14 activating the inflatable restraint 10 deems appropriate. This reduction in pressure ensures that the inflatable restraint 10 remains a non-lethal method of immobilizing a detainee and allows the person wearing the restraint 10 additional mobility.

Figure 10:
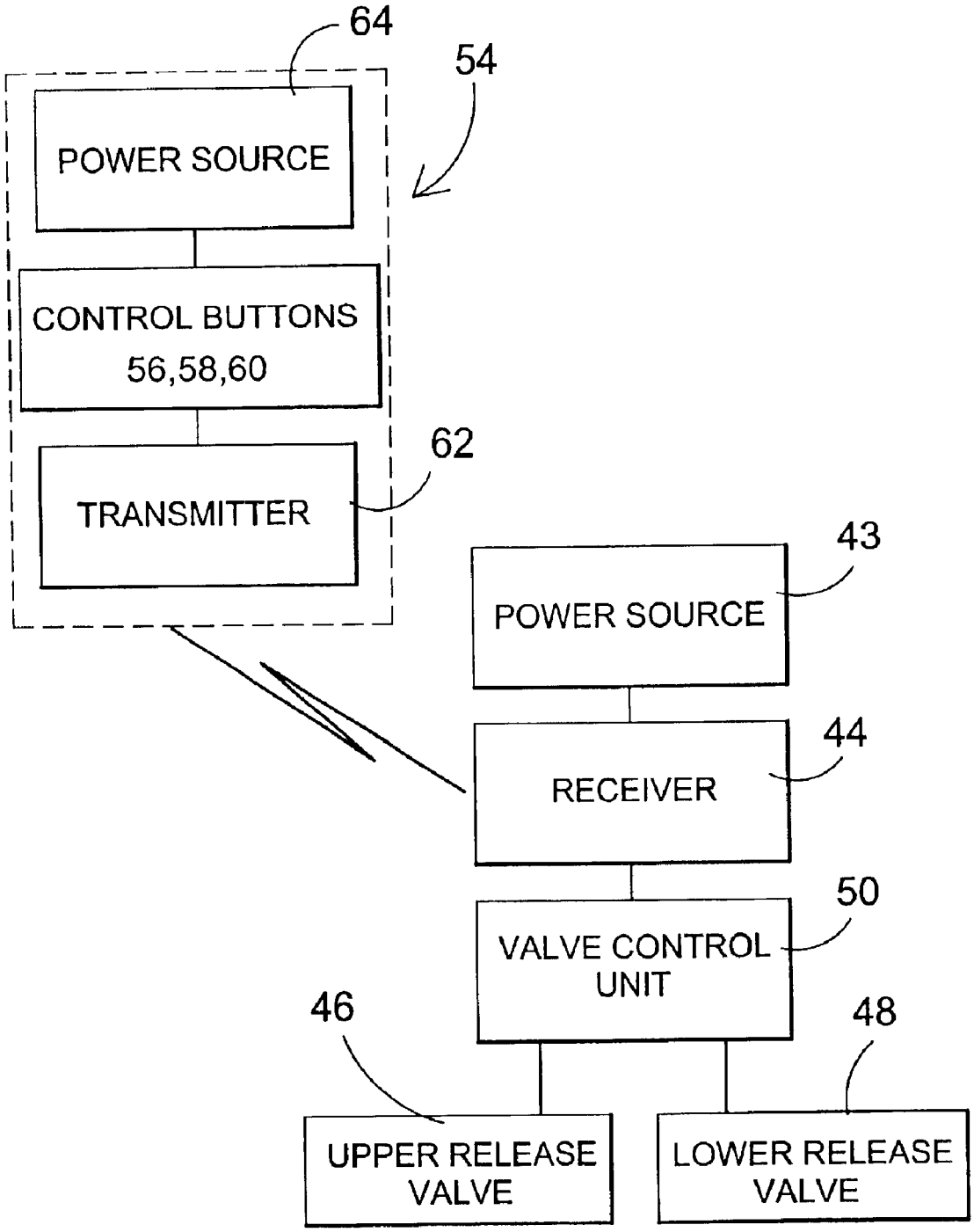
FIG. 10 is a block diagram showing the elements forming the inflatable restraint of the present invention.

FIG. 10 is a block diagram showing communication between the remote control unit 54 and the receiver 44 of the inflatable restraint 10 of the present invention. Shown is the remote control unit 54 including a transmitter having a button to allow for transmission of an activation command and buttons to vary the extent of inflation needed for restraint of a detainee wearing the present invention. Activation of the control buttons connects the power source to the transmitter to transmit an inflation or deflation signal to the inflatable restraint 10. Upon receipt o the transmitted signal the received signal is provided to the valve control unit 50. The valve control unit 50 analyzes the signal and controls the upper and lower release valves 46 and 48 respectively, to inflate or deflate the chambers. Once activated, the valve control unit 50 signals the upper valve release 46 and the lower valve release 48 to release the compressed air in the tanks 42. The compressed air travels through the upper inflation line 38 and lower inflation line 40 to inflate the inflatable member of the inflatable restraint 10.

Figure 11:
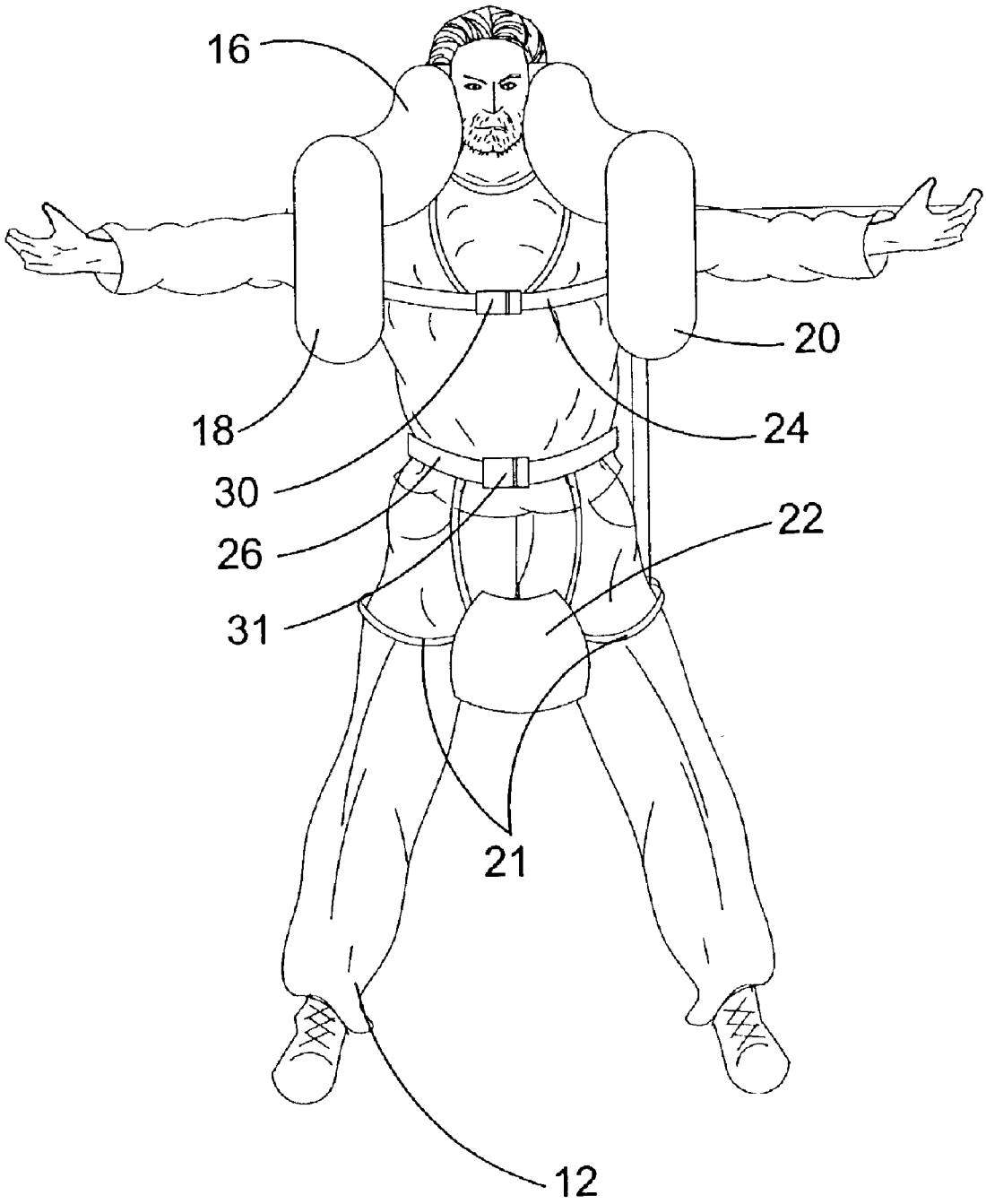
FIG. 11 is a perspective view of the inflatable restraint of the present invention worn by a person in its inflated state.

FIG. 11 a perspective view of the inflatable restraint of the present invention worn by a person in its inflated state. The inflatable restraint 10 is attached to a detainee by an upper harness 24 and a lower harness 26. The upper harness 24 and lower harness 26 are both connected to an inflation unit 32 by an upper support member 34 and a lower support member 36 as can be seen in FIGS. 3–5. The upper harness 24 is preferably maintained around the upper torso of the detainee 12 by shoulder straps 17 and is secured in position by a locking mechanism 30. The upper harness 24 is connected to a neck chamber 16 extending around a rear side of the neck of a detainee 12. The upper harness 24 is also connected to both a right arm chamber 18 and a left arm chamber 20. The right arm chamber 18 preferably receives the right arm of the detainee 12 and is positioned at the joint between the right arm and shoulder. The left arm chamber 20 preferably receives the left arm of the detainee 12 and is positioned at the joint between the left arm and shoulder. The lower harness 26 of the inflatable restraint 10 is preferably maintained around the waist and legs of the detainee 12 by thigh straps 21 and is secured in position by a locking mechanism 31. The lower harness a leg chamber positioned between the legs of the detainee 12 and held in position by the thigh straps 21.

When immobilization is required, a person 14, preferably a law enforcement official, activates the remote control unit 54 which transmits a signal to the inflation unit 32. The signal is received by a receiver 44 connected to the inflation unit 32 and is provided to a valve control unit 50. The valve control unit 50 controls an upper and lower release valve 46, 48 to cause the air tanks 42 to release air into the neck chamber 16, the right arm chamber 18, the left arm chamber 20, and the leg chamber 22. As a result the detainee 12 is unable to move due to the inflated chambers surrounding his appendages. The inflatable chambers restrict movement sufficiently enough to prevent any resistance attempted by the detainee 12 and also adequately prevents attempted escape by the detainee.

FIG. 12 a perspective view of the inflatable restraint of the present invention in its inflated state. The inflatable restraint 10 is attached to a detainee by an upper harness 24 and a lower harness 26. The upper harness 24 and lower harness 26 are both connected to an inflation unit 32 by an upper support member 34 and a lower support member 36 as can be seen in FIGS. 3–5. The upper harness 24 is preferably maintained around the upper torso of the detainee 12 by shoulder straps 17 and is secured in position by a locking mechanism 30. The upper harness 24 is connected to a neck chamber 16 extending around a rear side of the neck of a detainee 12. The upper harness 24 is also connected to both a right arm chamber 18 and a left arm chamber 20. The right arm chamber 18 preferably receives the right arm of the detainee 12 and is positioned at the joint between the right arm and shoulder. The left arm chamber 20 preferably receives the left arm of the detainee 12 and is positioned at the joint between the left arm and shoulder. The lower harness 26 of the inflatable restraint 10 is preferably maintained around the waist and legs of the detainee 12 by thigh straps 21 and is secured in position by a locking mechanism 31. The lower harness a leg chamber positioned between the legs of the detainee 12 and held in position by the thigh straps 21.

FIG. 13 a detailed illustrative view of the inflatable restraint of the present invention in its inflated state. Shown herein is the position of a right arm of a detainee 12 when the inflatable restraint 10 is inflated. The right arm chamber 18 of the inflatable restraint 10 positioned around a right arm of a detainee and held in position by the upper harness 24. The upper harness 24 is connected to an inflation unit 32 by an upper support member 34. The upper harness 24 is positioned around the upper torso of the detainee 12 and held in place by shoulder straps 17. A locking mechanism 30 secures the upper harness in position. The upper harness 24 is connected to a neck chamber 16 extending around a rear side of the neck of a detainee 12. In this figure, the right arm of the detainee 12 is immobilized by the inflated right arm chamber 18. Further, the detainee's 12 head is immobilized by the inflated neck member 16. This figure shows the detainee is unable to move effectively and thereby, if required, completely immobile and subdued.

From the above description it can be seen that the inflatable restraint of the present invention is able to overcome the shortcomings of prior art restraint devices by providing a non-lethal way in which to immobilize a person by inflating members around the appendages that control a persons movements. Furthermore, the present invention is simple and easy to produce and use.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An inflatable restraint for selectively restraining movement of a person, said restraint comprising:

a) an inflation unit;

b) a harness; and c) a plurality of selectively inflatable chambers connected to said harness strategically positioned around selective parts of a body of the person and held in position by said harness whereby upon activation of said inflation unit said plurality of selectively inflatable chambers are caused to inflate thereby restricting movement of the selective body parts of the person, wherein said plurality of selectively inflatable chambers includes:

a) a neck chamber for positioning around a rear portion of the neck of the person and extending partially therearound;

b) a right arm chamber for receiving a right arm of the person;

c) a left arm chamber for receiving a left arm of the person; and d) a leg chamber positioned between the legs of the person.

2. The inflatable restraint as recited in claim 1, wherein said harness comprises:

a) a lower harness for positioning around a waist of the person, said lower harness connected to said leg chamber; and b) an upper harness for positioning around a torso of said person, said upper harness is connected to said neck chamber, right arm chamber, and left arm chamber.

3. The inflatable restraint as recited in claim 1 further comprising a remote control unit for transmitting a signal to said inflation unit for controlling said inflation unit to inflate said plurality of selectively inflatable chambers thereby restricting movement of the person wearing said inflatable restraint.

4. The inflatable restraint as recited in claim 2 further comprising a remote control unit for transmitting a signal to said inflation unit for controlling said inflation unit to inflate said plurality of selectively inflatable chambers thereby restricting movement of the person wearing said inflatable restraint.

5. The inflatable restraint as recited in claim 4, wherein said inflation unit further comprises:

a) at least one compressed air tank; and b) a housing comprising:

i) a valve control unit for selectively restricting flow of air from said at least one compressed air tank;

ii) a power source connected to said valve control unit;

iii) an inflation line extending between said at least one compressed air tank and said plurality of selectively inflatable chambers for supplying air thereto.

6. The inflatable restraint as recited in claim 5, wherein said inflation line includes an upper inflation line connected between said at least one compressed air tank and all of said neck chamber, right arm chamber, and left arm chamber for supplying air thereto, and a lower inflation line connected between said at least one compressed air tank and said leg chamber for supplying air thereto.

7. The inflatable restraint as recited in claim 3, wherein said inflation unit further comprises:

a) at least one compressed air tank; and b) a housing comprising:

i) a valve control unit for selectively restricting flow of air from said at least one compressed air tank;

ii) a power source connected to said valve control unit; and iii) an inflation line extending between said at least one compressed air tank and said plurality of selectively inflatable chamber, for supplying air thereto, and wherein said remote control unit includes:

a) an inflation button for generating a signal for controlling said inflation unit to instantaneously inflate said plurality of inflatable chambers;

b) a pressure increase for generating a signal for controlling said inflation unit for selectively increasing the amount of air released by said at least one compressed air tank; and c) a pressure decrease for generating a signal for controlling said inflation unit for selectively decreasing the air pressure within said inflatable chambers.

8. The inflatable restraint as recited in claim 5, wherein said remote control unit includes:

a) an inflation button for generating a signal for controlling said inflation unit to instantaneously inflate said plurality of inflatable chambers;

b) a pressure increase for generating a signal for controlling said inflation unit for selectively increasing the amount of air released by said at least one compressed air tank; and c) a pressure decrease for generating a signal for controlling said inflation unit for selectively decreasing the air pressure within said inflatable chambers.

9. The inflation restraint as recited in claim 1, wherein said inflation unit contains a first air tank and a second air tank.

10. The inflation restraint as recited in claim 6, wherein said inflation unit contains a first air tank and a second air tank.

11. The inflation restraint as recited in claim 10, wherein said first air tank is connected to said upper inflation line and said second air tank is connected to said lower inflation line.

12. The inflation restraint as recited in claim 6, wherein the upper inflation line is enclosed within a protective shell.

13. The inflation restraint as recited in claim 6, wherein the lower inflation line is enclosed within a protective shell.

14. The inflation restraint as recited in claim 12, wherein the lower inflation line is enclosed within a protective shell.

* * * * *